US005343585A

United States Patent [19]

Howell

[11] Patent Number: 5,343,585

[45] Date of Patent: Sep. 6, 1994

[54] PAINT BRUSH ASSEMBLY

[76] Inventor: Vernon L. Howell, 3200 S. Arville, #303, Las Vegas, Nev. 89102

[21] Appl. No.: 924,756

[22] Filed: Aug. 4, 1992

[51] Int. Cl.[5] ..... A46B 17/02; A46B 17/08

[52] U.S. Cl. ..... 15/111; 15/146; 15/150; 15/178; 15/202; 15/248.1

[58] Field of Search ..... 15/111, 146, 147.1, 15/149, 150, 178, 194, 202, 228, 244.1, 248.1; 16/114 A, 114 R; 30/169; 81/487; 294/33, 99.2

[56] References Cited

U.S. PATENT DOCUMENTS

| | | | |
|---|---|---|---|
| 428,491 | 5/1890 | Hortman | 15/111 |
| 604,477 | 5/1898 | Moritz | 15/145 |
| 825,063 | 7/1906 | Lawbauch | 30/169 |
| 1,538,536 | 5/1925 | Wisoff | 294/99.2 |
| 1,776,443 | 9/1930 | Martin | 15/111 |
| 2,428,306 | 9/1947 | Beagle | 15/150 |
| 2,563,422 | 8/1951 | Sabo | 294/33 |
| 3,398,419 | 8/1968 | Carlos | 15/146 |
| 3,420,563 | 1/1969 | Witt | 294/33 |

FOREIGN PATENT DOCUMENTS

| | | | |
|---|---|---|---|
| 1363979 | 5/1964 | France | 294/99.2 |
| 266868 | 5/1950 | Switzerland | 294/99.2 |

*Primary Examiner*—Timothy F. Simone
*Assistant Examiner*—Randall E. Chin
*Attorney, Agent, or Firm*—E. Michael Combs

[57] ABSTRACT

A paint brush assembly includes a clip member arranged to secure a replaceable paint brush head thereto, with the clip member having a u-shaped body, including first and second cooperating jaws engaged with the brush head. A sleeve is received over the clip member subsequent to its securement relative to the brush head. A modification of the invention includes a shield structure, as well as a scraper blade mounted to the sleeve in use.

3 Claims, 4 Drawing Sheets

PAINT BRUSH ASSEMBLY

BACKGROUND OF THE INVENTION

1. Field of the Invention

The field of invention relates to paint brush members, and more particularly pertains to a new and improved paint brush assembly arranged to releasably mount a disposable brush head thereto.

2. Description of the Prior Art

The maintenance to include cleaning, storage, and the like of paint brushes subsequent to their use is a disagreeable and dangerous condition in use of combustible fluids such as solvents. The instant invention attempts to address deficiencies of the prior art by providing for a readily mounted and released paint brush head relative to a clip member body to permit ease of disposal of paint brush subsequent to their use. Prior art paint brushes to include a disposal applicator element is set forth in U. S. Pat. No. 4,155,139 wherein a paint brush head is received within a cover for subsequent disposal, with the cover having a handle projecting therefrom for securement of the paint brush head.

U.S. Pat. No. 4,890,350 sets forth a paint brush that is attachable to a handle utilizing an adhesive strip.

U.S. Pat. No. 4,993,671 sets forth a paint brush holder securable to a paint brush container to position and secure a paint brush for storage thereof.

As such, it maybe appreciated there continues to be a need for a new and improved paint brush assembly as set forth by the instant invention which addresses both the problems of use as well as effectiveness in construction in a manner not addressed by the prior art and in this respect, the present invention substantially fulfills this need.

SUMMARY OF THE INVENTION

In view of the foregoing disadvantages inherent in the known types of paint brush members now present in the prior art, the present invention provides a paint brush assembly wherein the same is arranged to releasably mount a paint brush head for subsequent disposal. As such, the general purpose of the present invention, which will be described subsequently in greater detail, is to provide a new and improved paint brush assembly which has all advantages of the prior art paint brush apparatus and none of the disadvantages.

To attain this, the present invention provides a paint brush assembly including a clip member arranged to secure a replaceable paint brush head thereto, with the clip member having a U-shaped body, including first and second cooperating jaws engaged with the brush head. A sleeve is received over the clip member subsequent to its securement relative to the brush head. A modification of the invention includes a shield structure, as well as a scraper blade mounted to the sleeve in use.

My invention resides not in any one of these features per se, but rather in the particular combination of all of them herein disclosed and claimed and it is distinguished from the prior art in this particular combination of all of its structures for the functions specified.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint brush assembly which has all the advantages of the prior art paint brush apparatus and none of the disadvantages.

It is another object of the present invention to provide a new and improved paint brush assembly which may be easily and efficiently manufactured and marketed.

It is a further object of the present invention to provide a new and improved paint brush assembly which is of a durable and reliable construction.

An even further object of the present invention is to provide a new and improved paint brush assembly which is susceptible of a low cost of manufacture with regard to both materials and labor, and which accordingly is then susceptible of low pieces of sale to the consuming public, thereby making such paint brush assemblies economically available to the buying public.

Still yet another object of the present invention is to provide a new and improved paint brush assembly which provides in the apparatus and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
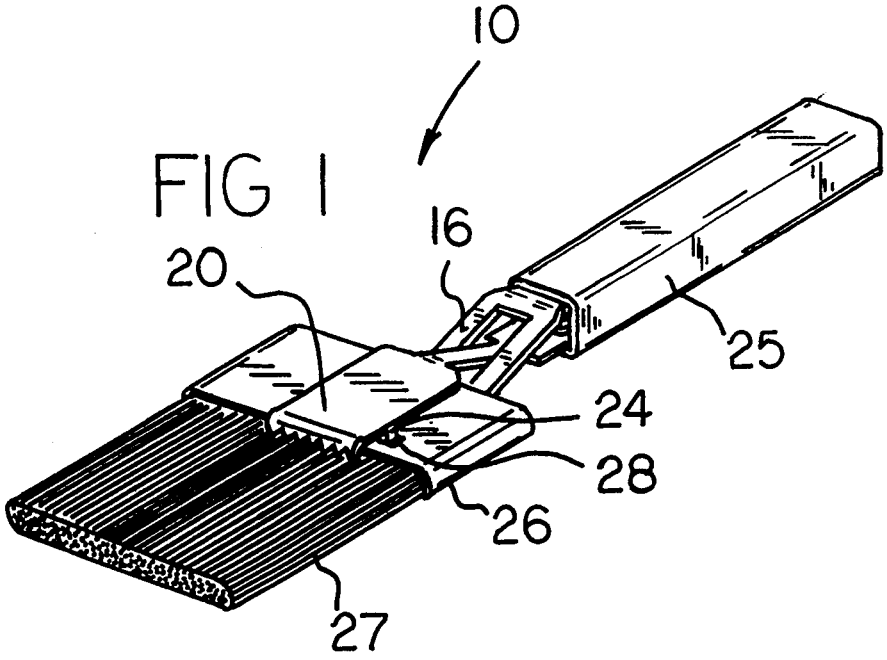
FIG. 1 is an isometric illustration of the instant invention.
Figure 2:
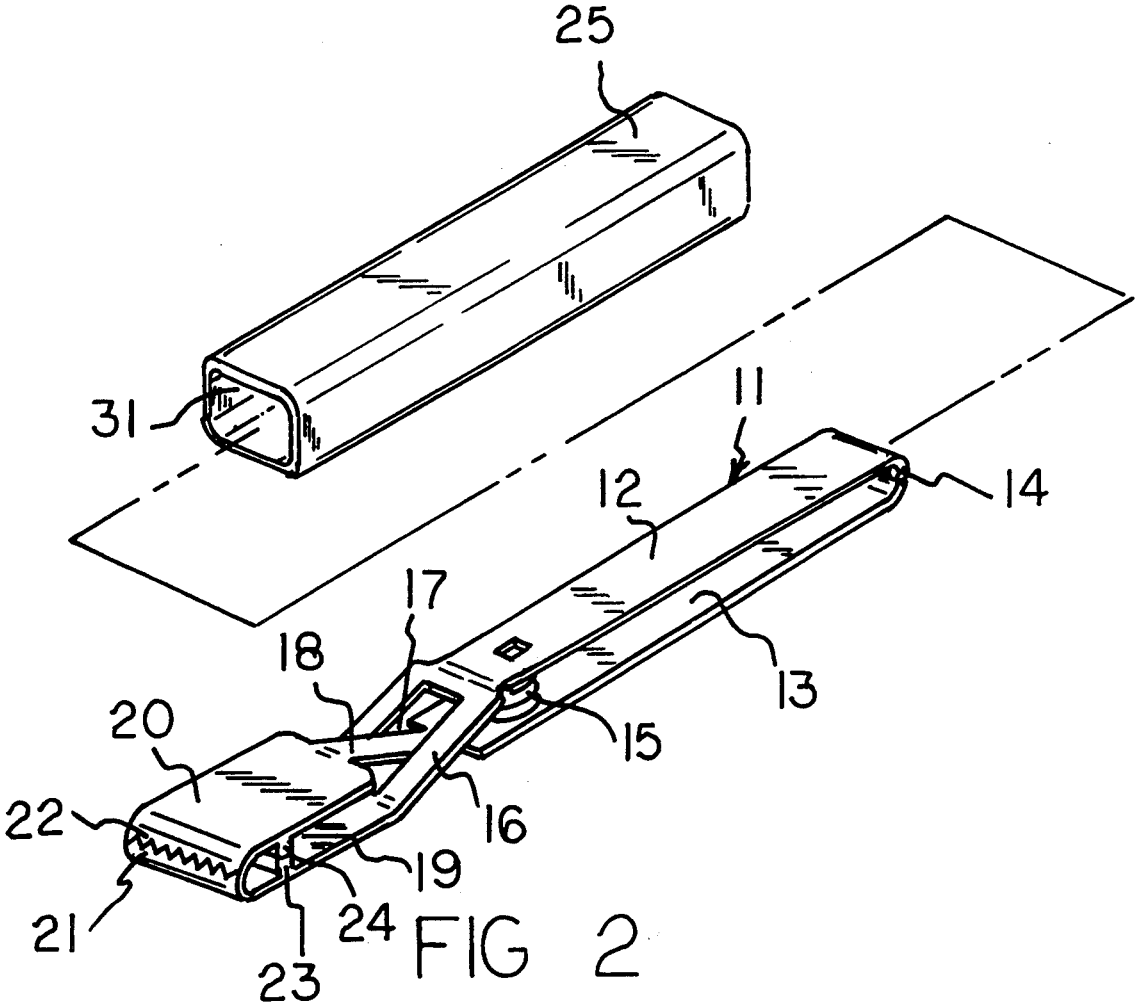
FIG. 2 is an isometric exploded view of the clip member and associated tubular sleeve utilized by the invention.
Figure 3:
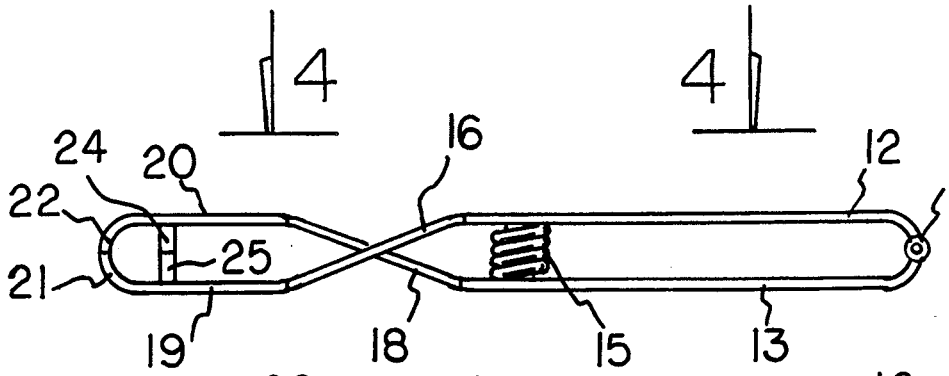
FIG. 3 is an orthographic side view of the clip member.
Figure 4:
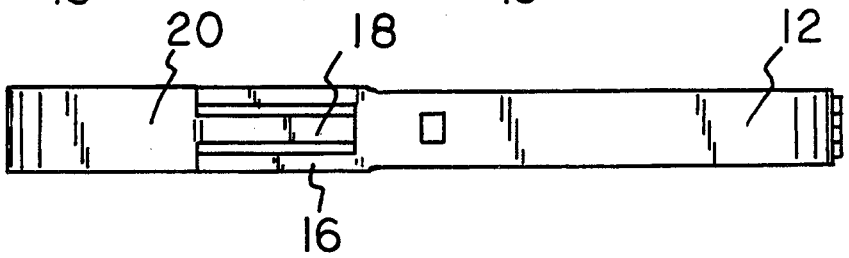
FIG. 4 is an orthographic view, taken along the lines 4—4 of FIG. 3 in the direction indicated by the arrows.
Figure 6:
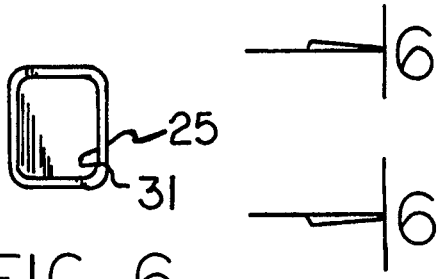
FIG. 6 is an orthographic view, taken along the lines 6—6 of FIG. 5 in the direction indicated by the arrows.
Figure 5:
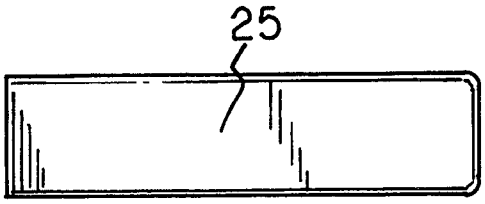
FIG. 5 is an orthographic top view of the sleeve.
Figure 7:
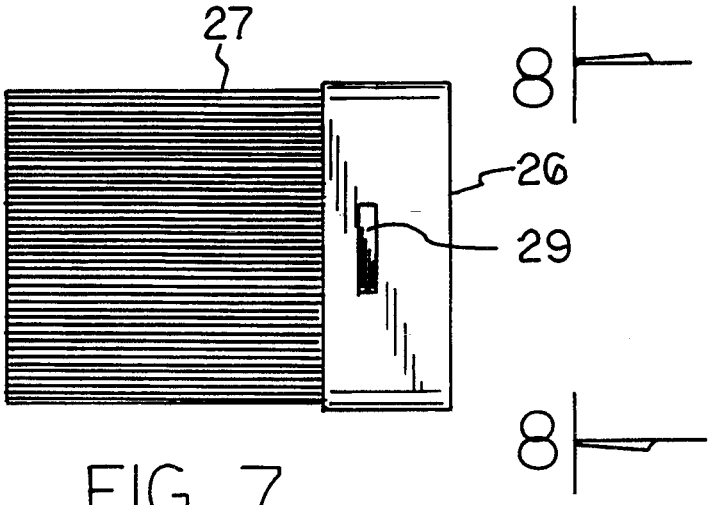
FIG. 7 is an orthographic view of the brush head.
Figure 8:
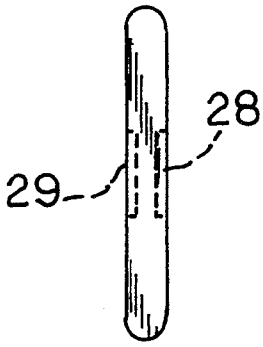
FIG. 8 is an orthographic view, taken along the lines 8—8 of FIG. 7 in the direction indicated by the arrows.

With reference now to the drawings, and in particular to FIGS. 1 to 12 thereof, a new and improved paint brush assembly embodying the principles and concepts of the present invention and generally designated by the reference numeral 10 will be described.

More specifically, the paint brush assembly 10 of the instant invention essentially comprises a clip member 11 having a U-shaped body to include a first plate 12 coextensive with a second plate 13 spaced therefrom and joined by a connecting web 14 at respective first end portions of the first and second plates 12 and 13 permitting pivoting of the first plate relative to the second plate. A second end portion of the first plate includes a first clamp leg 16 extending from the first plate canted downwardly at a predetermined obtuse included angle beyond the second plate at its second end, with the second plate second end having a second clamp leg. The first clamp leg 16 includes a first clamp leg slot 17, with a second clamp leg 18 directed through the first clamp leg slot 17, as the second clamp leg 18 is directed and oriented at predetermined obtuse included angle between the second clamp leg and the second plate 13. A spring member 15 is interposed between the first and second plates 12 and 13 adjacent their second ends as illustrated to bias the first and second plates in an opposed relationship relative to one another. The first clamp leg 16 includes a first clamp jaw plate 19 that is oriented parallel relative to the first plate 12 extending beyond the first plate 12 and a second clamp jaw plate 20 mounted fixedly to the second clamp leg 18 oriented parallel relative to the second plate 13, with the first and second clamp jaw plates 19 and 20 arranged in confronting coextensive relationship relative to one another having respective first and second jaws 21 and 22 of interdigitated teeth biased towards one another by the spring member 15. A first jaw plate flange 23 is fixedly and orthogonally mounted to the first clamp jaw plate 19 arranged in an aligned orientation relative to a second jaw plate flange 24 mounted in confronting relationship relative to the first jaw plate 23, with the first jaw plate flange 24 fixedly and orthogonally mounted to the second jaw plate 20. A brush head 26 is provided having a matrix of bristles 27 extending therefrom, with the brush head 26 including parallel and coextensive first and second grooves 28 and 29 receiving the first and second jaw plate flanges 23 and 24 respectively therewithin. The first and second jaws 21 and 22 extend beyond the first and second grooves 28 and 29 to engage the periphery of the brush head 26 at an inner face of the brush head 26 and the bristles 27.

Figure 9:
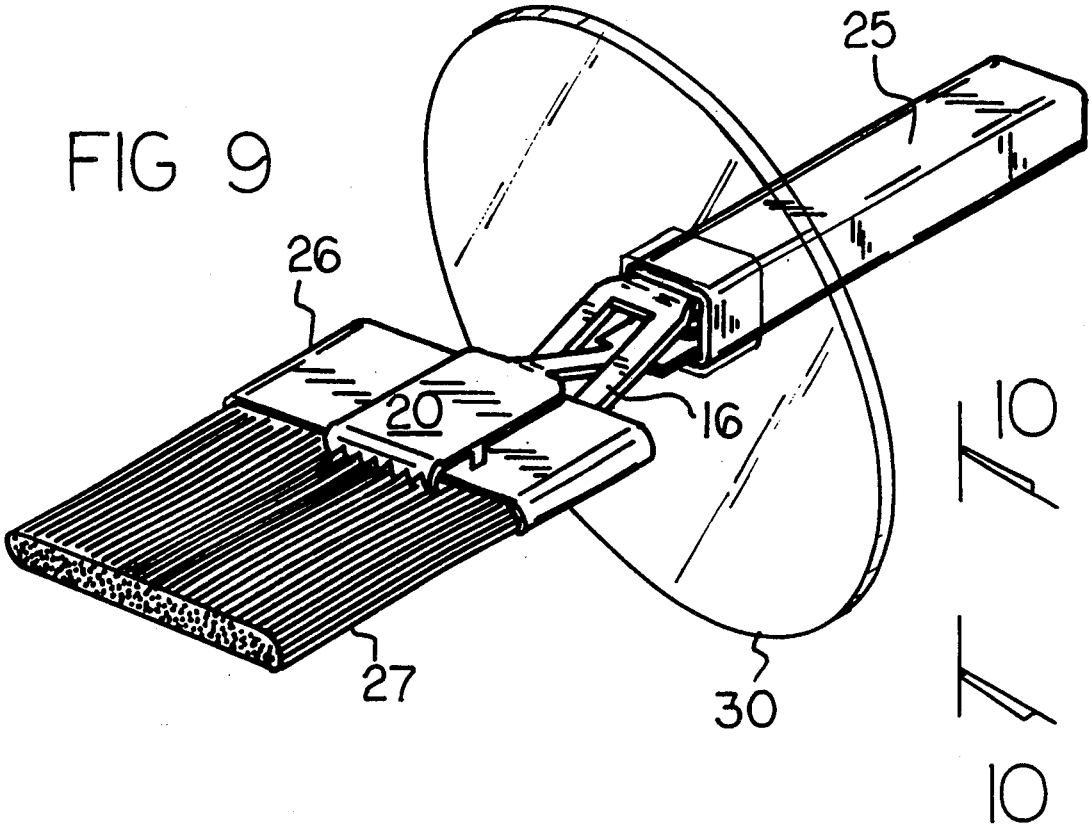
FIG. 9 is an isometric illustration of the invention employing a shield plate.
Figure 10:
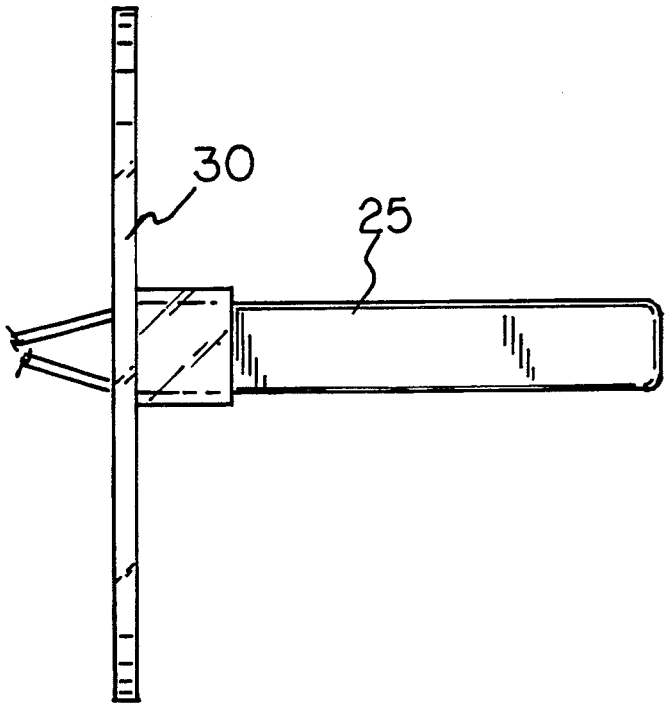
FIG. 10 is an orthographic top view of the shield plate mounted to the tubular sleeve.
Figure 11:
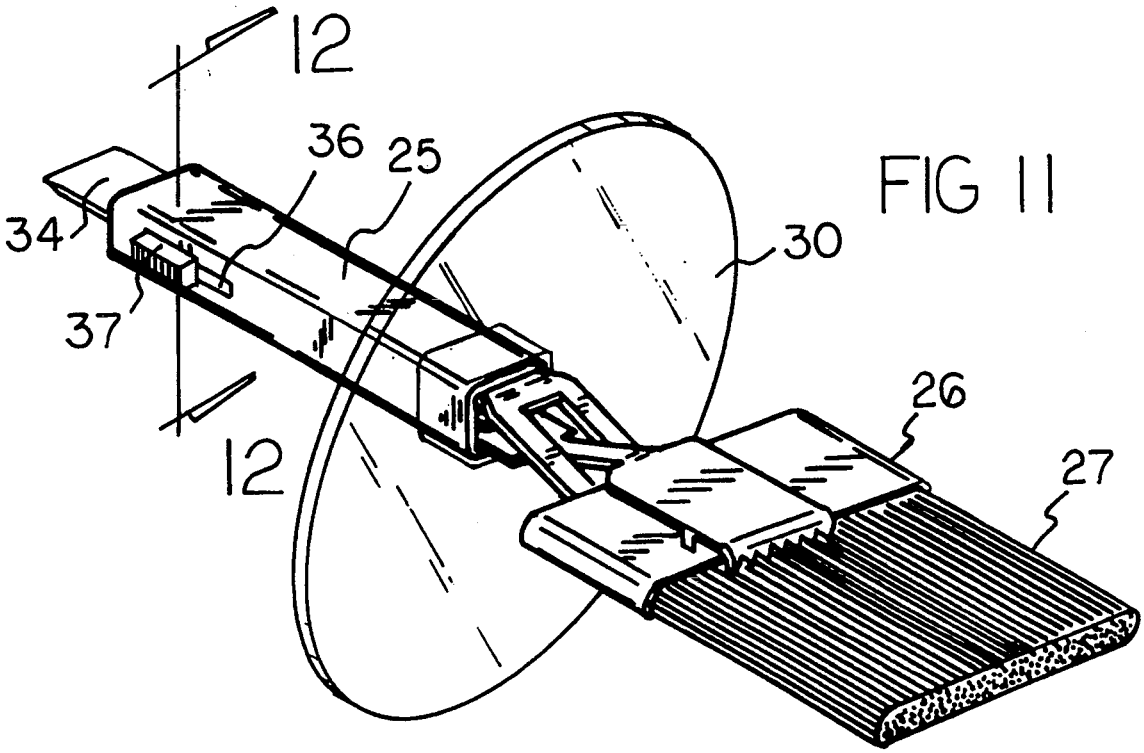
FIG. 11 is an isometric illustration of the invention employing a scraper blade structure.
Figure 12:
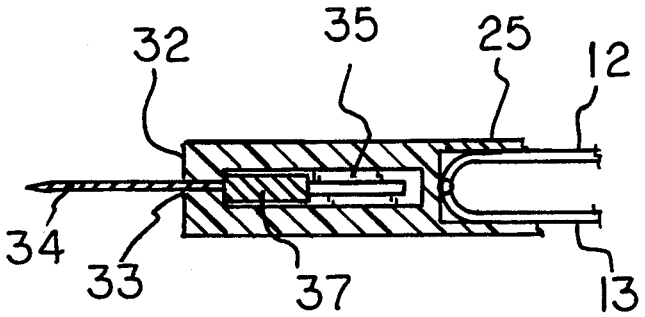
FIG. 12 is an orthographic view, taken along the lines 12 —12 of FIG. 11 in the direction indicated by the arrows.

The FIG. 9 for example indicates the use of a transparent shield plate 30 fixedly mounted orthogonally to the tubular sleeve 25 at a second end of the tubular sleeve having an entrance opening 31 arranged to receive the clip member 11, and more specifically the first and second plates 12 and 13 therewithin. The tubular sleeve opening 31 includes the shield plate 30 orthogonally mounted extending beyond the tubular sleeve 25 to afford protection of an individual's hand during use of the organization.

The sleeve 25 is also arranged to include a sleeve rear wall 32 at a first end of the sleeve 25 spaced from the entrance opening 31. The sleeve rear wall 32 includes a through-extending slot 33 in communication with a cavity 35 within the sleeve, with a scraper blade 34 mounted within a cavity arranged for extension through the rear wall slot 33. The scraper blade 34 includes a handle lug 37 mounted thereto, with the handle lug extending through a side wall slot 36, whereupon engagement of the handle lug 37 permits sliding of the handle lug 37 and the associated scraper blade 34 from within the scraper blade cavity 35 to position exteriorly of the sleeve rear wall 32 to permit utilization of the scraper blade to effect scraping of loose paint and the like in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint brush assembly, comprising, a clip member, the clip member having a U-shaped body, including a first plate coextensive with a second plate, with the first plate having a first plate first end, and the second plate having a second plate first end, with the second plate first end and the first plate first end having an interconnecting web pivotally mounting the first plate relative to the second plate, and a spring member interposed between the first plate and the second plate, the first plate having a first plate second end, the second plate having a second plate second end, with first clamp means mounted to the first plate second end, and second clamp means mounted to the second plate second end, wherein the first clamp means and the second clamp means are arranged for biased confronting projection towards one another, and a brush member, the brush member having a brush head, and the first clamp means and the second clamp means arranged for selectively securing the brush head between the first clamp means and the second clamp means, with the brush head having a matrix of bristles extending from the brush head beyond the clip member, and the first clamp means includes a first clamp leg, and the second clamp means includes a second clamp leg, with the first clamp leg including a first clamp leg slot, and the second clamp leg directed through the first clamp leg slot, and a first clamp jaw plate fixedly secured to the first clamp leg parallel to the first plate, and a second clamp jaw plate mounted to the second clamp leg arranged parallel relative to the second plate, and the first clamp jaw plate including a first jaw and the second clamp jaw plate including a second jaw, and the first jaw and the second jaw including interdigitated teeth member, wherein the first jaw and second jaw engage opposed sides of the brush head at an interface between the bristles and the brush head, and the first clamp jaw plate includes a first jaw plate flange fixedly and orthogonally mounted to the first clamp jaw plate, the second clamp jaw plate includes a second jaw plate flange fixedly and orthogonally mounted to the second clamp jaw plate, wherein the first jaw plate flange and the second jaw plate flange are arranged in a coextensive aligned and confronting relationship relative to one another, and the brush head includes a first groove receiving the first jaw plate flange, and the brush head includes a second groove receiving the second jaw plate flange, and a tubular sleeve, the tubular sleeve including a tubular sleeve end having a rear wall and a tubular sleeve second end, the second end including an entrance opening slidably receiving the clip member within the tubular sleeve for encasing the first plate and the second plate within the tubular sleeve for manual grasping of the clip member.

2. A paint brush assembly as set forth in claim 1 including a transparent shield plate fixedly and orthogonally mounted to the tubular sleeve at the tubular sleeve second end, with the shield plate extending laterally beyond the tubular sleeve.

3. A paint brush assembly as set forth in claim 2 wherein the rear wall includes a rear wall slot, and a scraper blade, the blade being slidably directed through the rear wall slot, and a scraper blade cavity positioned within the tubular sleeve in adjacency to the rear wall, and the scraper blade telescopingly received relative to the scraper blade cavity, and the sleeve having a side wall slot, and the scraper blade having a handle lug directed through the side wall slot fixedly secured to the scraper blade to permit sliding of the scraper blade relative to the scraper blade cavity.

* * * * *